US009222666B2

(12) United States Patent
Liu

(10) Patent No.: US 9,222,666 B2
(45) Date of Patent: Dec. 29, 2015

(54) SWIRLER, COMBUSTION CHAMBER, AND GAS TURBINE WITH IMPROVED SWIRL

(75) Inventor: Kexin Liu, Lincoln (GB)

(73) Assignee: SIEMENS AKTIENGESELLSCHAFT, München (DE)

( * ) Notice: Subject to any disclaimer, the term of this patent is extended or adjusted under 35 U.S.C. 154(b) by 1119 days.

(21) Appl. No.: 13/262,870

(22) PCT Filed: Feb. 11, 2010

(86) PCT No.: PCT/EP2010/051667

§ 371 (c)(1),
(2), (4) Date: Oct. 4, 2011

(87) PCT Pub. No.: WO2010/115648

PCT Pub. Date: Oct. 14, 2010

(65) Prior Publication Data

US 2012/0017595 A1 Jan. 26, 2012

(30) Foreign Application Priority Data

Apr. 6, 2009 (EP) ..... 09005066

(51) Int. Cl.

| | |
|---|---|
| ***F23D 14/02*** | (2006.01) |
| ***F23R 3/14*** | (2006.01) |
| ***F23R 3/28*** | (2006.01) |

(52) U.S. Cl.

CPC . *F23D 14/02* (2013.01); *F23R 3/14* (2013.01); *F23R 3/286* (2013.01)

(58) Field of Classification Search

None

See application file for complete search history.

(56) References Cited

U.S. PATENT DOCUMENTS

| | | | | |
|---|---|---|---|---|
| 2,214,568 | A * | 9/1940 | Thomas | 431/264 |
| 3,657,885 | A * | 4/1972 | Bader | 60/737 |
| 3,691,762 | A * | 9/1972 | Ryberg et al. | 60/39.511 |
| 5,450,724 | A * | 9/1995 | Kesseli et al. | 60/737 |
| 5,761,906 | A * | 6/1998 | Norster | 60/737 |
| 5,822,992 | A * | 10/1998 | Dean | 60/737 |
| 5,941,075 | A * | 8/1999 | Ansart et al. | 60/748 |
| 5,947,081 | A * | 9/1999 | Kim | 123/306 |
| 6,192,669 | B1 * | 2/2001 | Keller et al. | 60/804 |
| 6,289,677 | B1 * | 9/2001 | Prociw et al. | 60/748 |
| 6,301,899 | B1 * | 10/2001 | Dean et al. | 60/737 |
| 7,104,251 | B2 * | 9/2006 | Kim | 123/306 |
| 2001/0027637 | A1 * | 10/2001 | Norster et al. | 60/39.03 |
| 2004/0142294 | A1 * | 7/2004 | Niass | F23C 7/002 431/278 |
| 2005/0257530 | A1 * | 11/2005 | Zupanc et al. | 60/776 |
| 2005/0279862 | A1 * | 12/2005 | Mao et al. | 239/403 |

(Continued)

FOREIGN PATENT DOCUMENTS

| | | | |
|---|---|---|---|
| CN | 1497216 | A | 5/2004 |
| CN | 101220955 | A | 7/2008 |

(Continued)

*Primary Examiner* — Phutthiwat Wongwian
*Assistant Examiner* — Karthik Subramanian

(57) ABSTRACT

A swirler for mixing fuel and air is provided. The swirler includes a plurality of vanes positioned radially around a central axis of the swirler and a plurality of mixing channels for mixing fuel and air. At least one mixing channel of the plurality of mixing channels is defined by opposite walls of two adjacent vanes of the plurality of vanes. The at least one mixing channel includes at least one fuel injection opening arranged at an upstream sections of the at least one mixing channel. The at least one mixing channel also includes an axial swirler arranged at a downstream section of the at least one mixing channel.

18 Claims, 7 Drawing Sheets

(56) References Cited

U.S. PATENT DOCUMENTS

| | | | | |
|---|---|---|---|---|
| 2006/0257807 | A1* | 11/2006 | Hicks et al. | 431/354 |
| 2006/0266046 | A1* | 11/2006 | Bonzani et al. | 60/746 |
| 2007/0028624 | A1* | 2/2007 | Hsieh et al. | 60/776 |
| 2008/0041060 | A1* | 2/2008 | Nilsson et al. | 60/737 |
| 2009/0025394 | A1* | 1/2009 | Bonzani et al. | 60/748 |
| 2009/0025395 | A1* | 1/2009 | Nilsson et al. | 60/748 |
| 2009/0277179 | A1* | 11/2009 | Wilbraham | 60/748 |
| 2009/0301092 | A1* | 12/2009 | Wilbraham | 60/748 |
| 2009/0320485 | A1* | 12/2009 | Wilbraham | 60/748 |

FOREIGN PATENT DOCUMENTS

| | | | |
|---|---|---|---|
| CN | 1497216 | A | 10/2008 |
| EP | 1921378 | A2 | 5/2008 |
| EP | 1992878 | A1 | 11/2008 |
| GB | 865140 | A | 4/1961 |
| GB | 2334087 | A | 8/1999 |
| GB | 2435508 | A | 8/2007 |
| GB | 2443431 | A | 5/2008 |
| GB | 2444737 | A | 6/2008 |
| RU | 2062405 | C1 | 6/1996 |
| RU | 2157954 | C2 | 10/2000 |

* cited by examiner

SWIRLER, COMBUSTION CHAMBER, AND GAS TURBINE WITH IMPROVED SWIRL

CROSS REFERENCE TO RELATED APPLICATIONS

This application is the US National Stage of International Application No. PCT/EP2010/051667, filed Feb. 11, 2010 and claims the benefit thereof. The International Application claims the benefits of European application No. 09005066.7 filed Apr. 6, 2009. All of the applications are incorporated by reference herein in their entirety

FIELD OF THE INVENTION

The invention relates to a swirler, particularly of a gas turbine, and improvements for the further diminishment of air pollutants such as nitrogen oxides ($NO_x$).

BACKGROUND OF THE INVENTION

In a gas turbine burner a fuel is burned to produce hot pressurised exhaust gases which are then fed to a turbine stage where they, while expanding and cooling, transfer momentum to turbine blades thereby imposing a rotational movement on a turbine rotor. Mechanical power of the turbine rotor can then be used to drive a generator for producing electrical power or to drive a machine. However, burning the fuel leads to a number of undesired pollutants in the exhaust gas which can cause damage to the environment. Therefore, it takes considerable effort to keep the pollutants as low as possible. One kind of pollutant is nitrogen oxide ($NO_x$). The rate of formation of nitrogen oxide depends exponentially on the temperature of the combustion flame. It is therefore attempted to reduce the temperature over the combustion flame in order to keep the formation of nitrogen oxide as low as possible.

There are two main measures by which reduction of the temperature of the combustion flame is achievable. The first is to use a lean stoichiometry with a fine distribution of fuel in the air, generating a fuel/air mixture with a low fuel fraction. The relatively small fraction of fuel leads to a combustion flame with a low temperature. The second measure is to provide a thorough mixing of fuel and air before the combustion takes place. The better the mixing, the more uniformly distributed the fuel is in the combustion zone and the fewer regions exist where the fuel concentration is significantly higher than average. This helps to prevent hotspots in the combustion zone which would arise from local maxima in the fuel/air mixing ratio. With a high local fuel/air concentration the temperature will rise in that local area and so does as a result also the $NO_x$ in the exhaust.

Modern gas turbine engines therefore use the concept of premixing air and fuel in lean stoichiometry before the combustion of the fuel/air mixture. Usually the pre-mixing takes place by injecting fuel into an air stream in a swirling zone of a combustor which is located upstream from the combustion zone. The swirling leads to a mixing of fuel and air before the mixture enters the combustion zone.

GB 2334087 A is addressing the specific problem to improve the fuel to air ratio during start-up of a "lean burn" combustor. A combustor comprises a swirler with at least one restrictor to restrict the flow of fluid through the combustor. Preferably the restrictor may be biased or switched between restricting and non-restricting positions depending on the pressure of the airflow. This may optimise the fuel/air mixture. On the other hand the restrictors may cause dead zones in which the airflow is unstable and stagnant with a possibility that flashbacks may occur.

From U.S. Pat. No. 6,192,669 B1 it is known to arrange a plurality of burners, operatively connected to each other, in such a way, so that a swirl flow is initiated in a common combustion chamber which ensures the stability of the flame front. This is advantageous because this may to low pollutant emissions, e.g. $NO_x$, at part load.

US patent application US 2006/0257807 A1 discloses a combustor with a swirler. Circular mixing ducts may be applied to a radial type swirler. This is advantageous due to the absence of corners where excessive fuel could get trapped.

With respect to the mentioned state of the art it is an object of the invention to provide a swirler, in particular a swirler in a gas turbine combustion chamber, a combustion chamber equipped with such a swirler, and a gas turbine having a plurality of such combustion chambers, so that mixing fuel and air in a swirling area is improved by providing a homogenous fuel/air mixture, especially at all possible loads of the gas turbine.

SUMMARY OF THE INVENTION

This objective is achieved by the independent claims. The dependent claims describe advantageous developments and modifications of the invention.

In accordance with the invention there is provided a swirler for mixing fuel and air comprising a plurality of vanes positioned radially around a central axis of the swirler and comprising a plurality of mixing channels for mixing fuel and air. At least one mixing channel of the plurality of mixing channels is defined by opposite walls of two adjacent vanes of the plurality of vanes. The at least one of the plurality of mixing channels is comprising at least one fuel injection opening arranged at an upstream sections of the at least one mixing channel and is comprising an axial swirler arranged at a downstream section of the at least one mixing channel.

Furthermore the invention is also directed at components comprising such a swirler, particularly a combustion chamber of a gas turbine. Furthermore the invention is also directed to a gas turbine comprising at last one of such a combustion chamber.

The inventive swirler is advantageous because the axial swirler provides an extra swirl, so that the fuel to air mixture is more homogenous.

Advantageously, the plurality of swirler airfoils may be arranged to provide a mixing channel individual rotating airflow for the at least one of the plurality of mixing channels.

Specifically the plurality of vanes may be configured that way that the mixed fuel and air mixture generates a swirl around the central axis of the swirler. The axial swirler preferably provides a rotational movement around the lateral axis of the mixing channel, to which the axial swirler is applied. As a result, from each mixing channel such rotating fuel/air mixture is entering a radially inner part of the swirler, in which the rotation around the swirler axis is initiated. Thus, several fuel/air streams with rotational movement—generated by the axial swirlers—along the lateral movement in direction of the mixing channels, get further mixed by the swirler resulting in an overall rotational movement along the central axis of the swirler. This results in an improved fuel to air mixture.

The mixing channel is a passage for fuel and air. The direction of this passage is defined by the orientation of the walls of the two adjacent opposite walls. Preferably the orientation of the walls is that way that—also ignoring the effect of the axial swirlers that are located in the mixing channels—the fuel and air will progress towards a central area of a swirler or burner and enter that central area slightly off the exact centre, so that the overall movement of the fuel and air will result in a corkscrew like movement around the central axis of the swirler or burner. Preferably the central axis of the swirler may be the same as the central axis of a burner, to which the swirler is applied.

Still ignoring the effect of the axial swirlers that are located in the mixing channels, the rotation of this corkscrew like movement may however be slower than the mean velocity by which the flow is traveling. This phenomenon is caused by the fact that the flow is turning, given a more tangential path around the central axis of the burner, which gives rise to a pressure difference between the neighbouring two swirler vanes in the flow passage.

In a preferred embodiment the axial swirler may extend between the walls of the two adjacent vanes. Preferably the axial swirler stretches over the complete cross section of the mixing channel through which is fuel and air mixture flows, so that advantageously all of the fuel and air mixture will pass the axial swirler. In an alternative embodiment a fraction of the fuel and air mixture may bypass the axial swirlers. This may occur, if the axial swirler does not extend over the complete cross section of the mixing channel.

In a further preferred embodiment the axial swirler may be arranged substantially perpendicular to the walls of the two adjacent vanes. This may result in a more symmetric swirl without any non-uniform turbulence. In an alternative construction the axial swirler may be in an angle different from 90 degrees in relation to the walls of the two adjacent vanes. If the walls of the two adjacent vanes are not in parallel, the axial swirler may be arranged so that it is substantially perpendicular in relation to the main flow direction within the mixing channel. Again, in an alternative solution, the angle may also be different from 90 degrees in relation to the main flow direction within the mixing channel.

In another preferred embodiment the axial swirler may have a plurality of swirler airfoils. The airfoils may be baffles to redirect the fuel/air stream and provide an additional rotational movement to the fuel/air stream passing the mixing channel. This may result in a corkscrew like movement at the end of the mixing channel.

In a further embodiment the axial swirler may have a rectangular solid frame surrounding the plurality of swirler airfoils. Advantageously the shape of the frame matches the cross section of the mixing channel.

In yet another embodiment, the plurality of swirler airfoils may have an elliptic, particularly circular, outer perimeter connected to the solid frame via this outer perimeter. Alternatively the plurality of swirler airfoils may have a rectangular, particularly square, outer perimeter connected to the solid frame via this outer perimeter.

The form of the swirler airfoils may be optimised to provide the best mixing in regards to a given arrangement of the walls and in regards to the position of the fuel injection openings. In one embodiment the plurality of swirler airfoils each may have a straight leading edge. Alternatively the plurality of swirler airfoils each may have a curved leading edge. Furthermore the plurality of swirler air foils each may have flat or a curved surface.

The swirler may be applied to a combustion chamber operating with liquid and/or gaseous fuel. In one preferred embodiment, the at least one fuel injection opening may be arranged to inject liquid fuel into an air flow flowing through the at least one of the plurality of mixing channels. In an alternative embodiment the at least one fuel injection opening may be arranged to inject gaseous fuel into an air flow flowing through the at least one of the plurality of mixing channels.

As a further option, the fuel injection openings are provided for both liquid and gaseous fuels. The fuel injection openings may be arranged in the same of at least one of the plurality of mixing channels for both types of fuels. Alternatively, the plurality of mixing channels may be equipped with fuel injection openings for liquid and gaseous fuels in an alternating or any other advantageous order.

The fuel injection openings may be arranged in various ways. Preferably they are located in a base plate of the swirler, each positioned substantially in the centre of the respective mixing channel. Alternatively the fuel injection openings may be positioned in the walls of the vanes. The fuel injection openings for gaseous fuel may be separate from the fuel injection openings for liquid fuel. Alternatively they may be arranged coaxially. The fuel injection openings for gaseous fuel may be positioned upstream of the fuel injection openings for liquid fuel.

Regarding their forms, orientations, and positions, the swirler itself, the vanes, the mixing channels, the fuel injection openings, and the axial swirlers may preferably be arranged in a homogeneous and substantially symmetric way, so that also a symmetric and uniform stream of mixed air and fuel in created.

In a further embodiment, the swirler or a burner-head may comprise at least one further fuel injection opening for providing pilot fuel—liquid or gas—arranged at a downstream section of the at least one mixing channel, further downstream of the axial swirler. Advantageously the pilot fuel may be controllable separately from the at least one fuel injection opening, which can be seen as "main fuel".

BRIEF DESCRIPTION OF THE DRAWINGS

Embodiments of the invention will now be described, by way of example only, with reference to the accompanying drawings, of which.

The illustration in the drawing is schematically. It is noted that for similar or identical elements in different figures, the same reference signs will be used.

DETAILED DESCRIPTION OF THE INVENTION

Not shown, a gas turbine engine comprises a compressor section, a combustor section and a turbine section which are arranged adjacent to each other. In operation of the gas turbine engine air is compressed by the compressor section and output to the burner section with one or more combustors.

Figure 1:
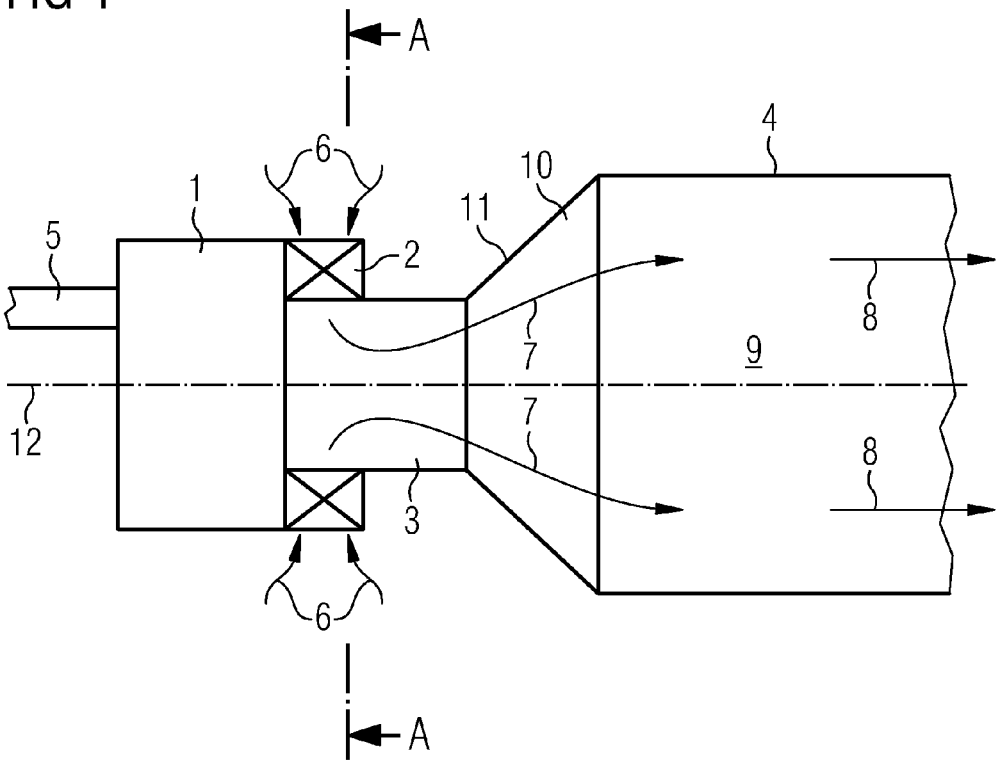
FIG. 1 shows schematically a longitudinal section through a combustor.

FIG. 1 shows a longitudinal section through a combustor, specifically a combustor within a gas turbine engine (not shown). The combustor comprises relative to a flow direction: a burner comprising a burner-head 1 and a swirler 2 attached to the burner-head 1, a transition piece referred to as combustion pre-chamber 3 and a main combustion chamber 4. The main combustion chamber 4 has a diameter being larger than the diameter of the pre-chamber 3. The main combustion chamber 4 is connected to the pre-chamber 3 via a dome portion 10 comprising a dome plate 11. In general, the transition piece 3 may be implemented as a one part continuation of the burner towards the combustion chamber 4, as a one part continuation of the combustion chamber 4 towards the burner, or as a separate part between the burner and the combustion chamber 4. The burner and the combustion chamber assembly show substantially rotational symmetry about a longitudinally symmetry axis 12.

A fuel supply 5 is provided for leading gaseous and/or liquid fuel to the burner which is to be mixed with inflowing air 6—particularly compressed air from a compressor (not shown)—in the swirler 2. By the swirler 2, the fuel and the air is mixed as will be explained later. The resulting fuel/air mixture 7 is then guided towards the primary combustion zone 9 where it is burnt to form hot, pressurised exhaust gases 8 flowing in a direction indicated by arrows to a turbine (not shown) of the gas turbine engine (not shown).

Figure 2:
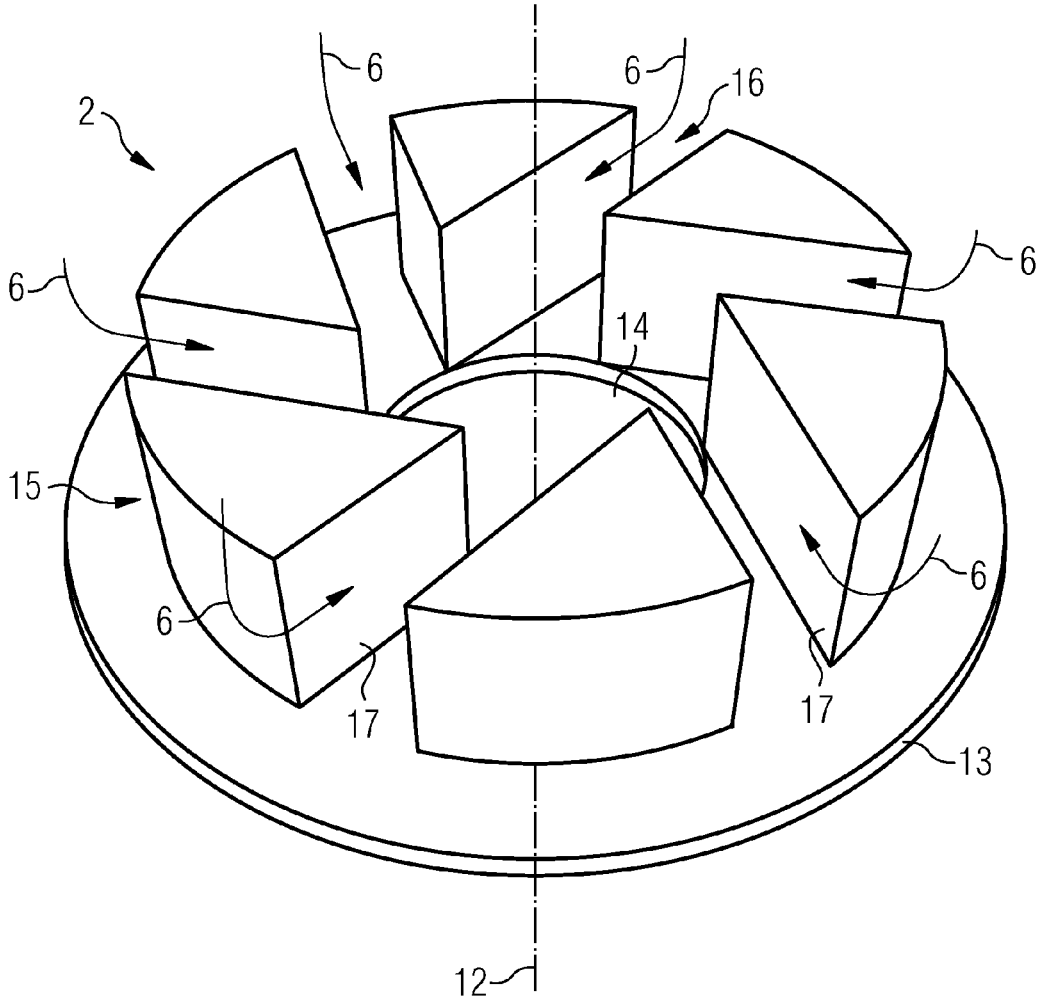
FIG 2 PRIOR ART
FIG. 2 shows schematically a perspective view of a prior art swirler.

A perspective view of a prior art swirler 2 is shown in FIG. 2. The swirler 2, which is a radial swirler, comprises a ring-shaped swirler vane support 13 or base plate with a central opening 14, which leaves a space for the burner face of the burner-head 1 once assembled as the overall burner (burner-head 1 is not shown in FIG. 2). As an example, six swirler vanes 15 each with asymmetric pie slice shape or in shape of an asymmetric cheese piece are disposed about the central axis 12 and arranged on the swirler vane support 13. The swirler vanes 15 can be fixed to the burner-head 1 (see FIG. 1) with their sides showing away from the swirler vane support 13. Swirler passages 16 as mixing channels are defined and delimited by opposing side faces 17 as walls of swirler vanes 15, by the surface of the swirler vane support 13 which shows to the burner-head 1 and by a surface (not shown) of the burner to which the swirler vanes 15 are fixed. Compressor air 6 flows from radially outside into these swirler passages 16 directed inwards and is mixed with fuel which is added through fuel injection openings (not shown).

The swirler passages 16 are arranged like that, that the fluid passing the passages 16 are directed to a radial outer section of the central opening 14. Furthermore the swirler passages 16 are substantially directed tangential to the radial outer section of the central opening 14. In this embodiment of the invention the opposing side faces 17 of a specific one of the swirler passages 16 are substantially planar and parallel to each other.

Figure 3:
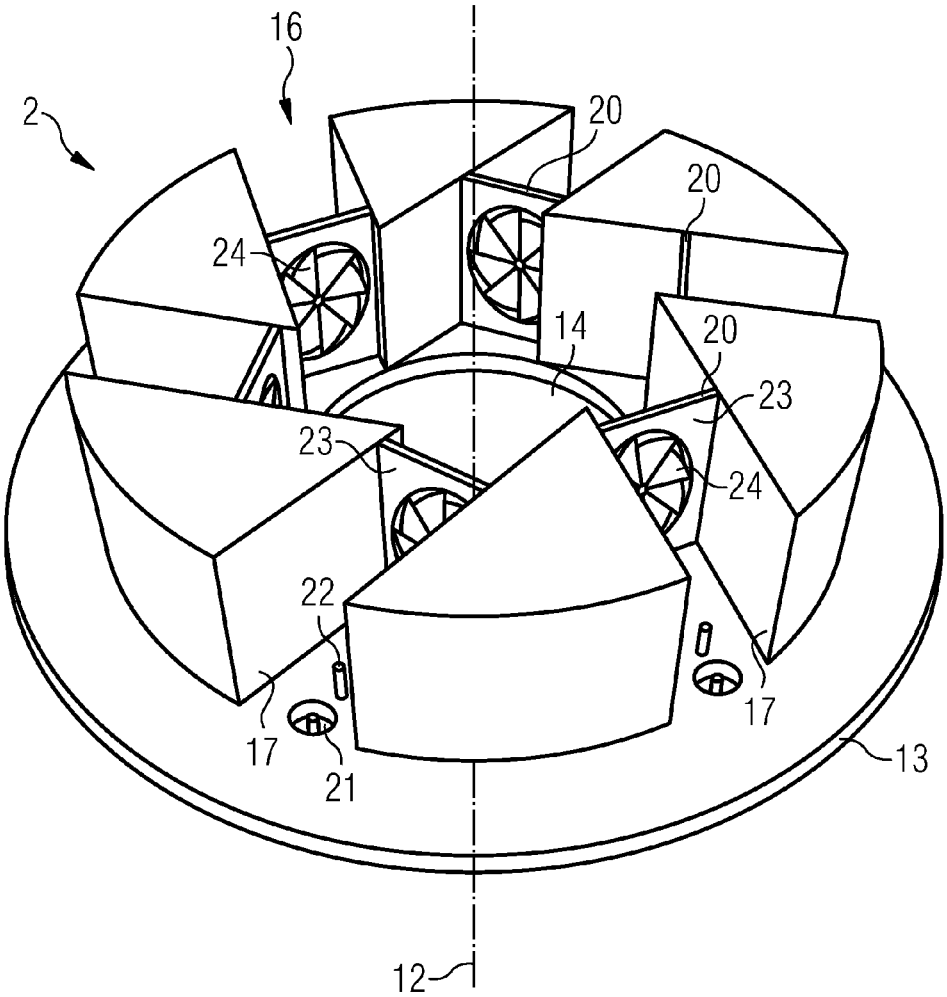
FIG. 3 illustrates schematically a perspective view of a swirler according to the invention.

Referring now to FIG. 3, based on the swirler shown in FIG. 2, the inventive swirler is described. The explanation of the form and the components of the swirler 2 given in respect to FIG. 2 still applies also for FIG. 3.

For each of the swirler passages 16, in FIG. 3 an axial swirler 20, a liquid fuel injector 22 and a gas fuel injector 21 is shown. Several fuel injectors, main and supplementary ones, may be provided. In this case, the shown fuel injectors 22, 21 should represent the main injectors. The gas fuel injector 21 is located at the radially outward end of the swirler passages 16, i.e. at the upstream end of the flowing air 6. The gas orifice may be plain to a surface of the swirler vane support 13. Next to the gas fuel injector 21, further downstream, the liquid fuel injector 22 may be located with an orifice that protrudes the surface of the swirler vane support 13.

Further downstream, in FIG. 3 close to the end of one of the side faces 17, the axial swirler 20 is located in each swirler passage 16. The axial swirler 20 is a device that provides a rotational movement to the fluid flowing through the swirler passage 16. Hence, fuel and air mixing is improved, which also may lead to a reduced emission.

In FIG. 3, the axial swirler 20 extends perpendicular to the side faces 17 over the complete width of the swirler passage 16. The axial swirler 20 also has the same height as the swirler vanes 15. The axial swirler 20 is arranged with an axial swirl generating arrangement, secured via a frame 23, the axial swirl generating arrangement comprising a plurality airfoils 24 each designed to redirect the fuel enriched air flow and apply a rotational or curling movement to this originally lateral flow along the direction of the swirler passage 16.

Figure 4:
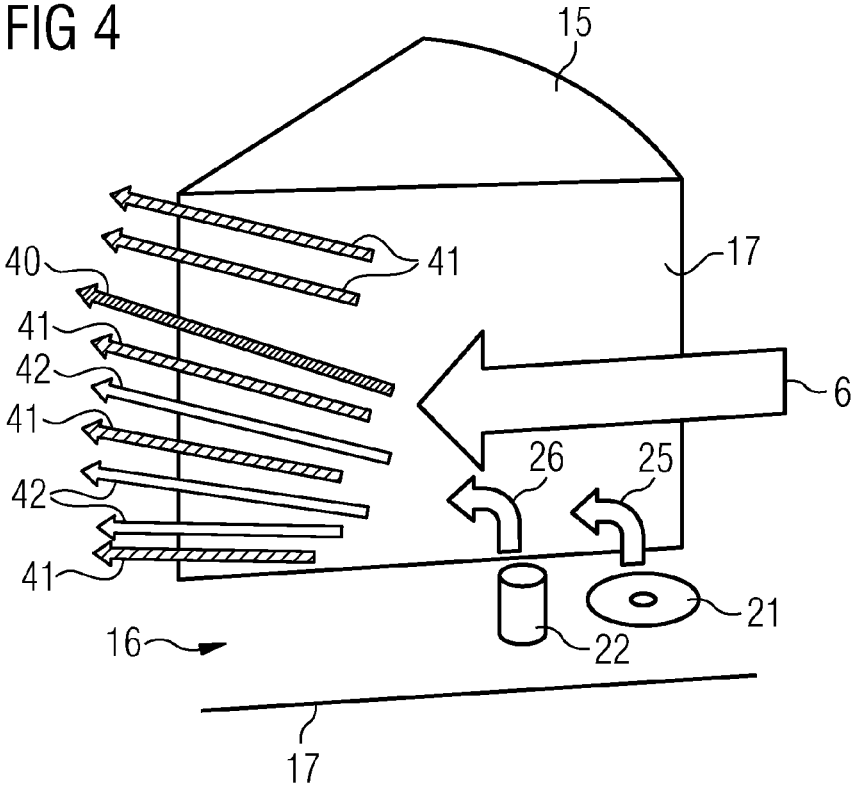
FIG. 4 illustrates distribution of fuel and air in a passage of a swirler.

Referring now to FIG. 4, the distribution of fuel and air in the swirler passage 16 is shown, when no axial swirler is provided for additional mixing. The swirler passage 16 is defined by the walls 17 (one of them is only indicated by a single line). One of the swirler vanes 15 is shown, together with the liquid fuel injector 22 and the gas fuel injector 21 in the adjacent swirler passage 16. The direction of the main air 6 is indicated by a broad arrow, leading straight into the swirler passage 16 from the upstream end of the swirler passage 16. The directions of the liquid fuel 26 and gas fuel 25 are bent arrows to indicate, that liquid fuel 26 and gas fuel 25 get entrained by the air 6 to the downstream side.

The fuel 25, 26 get mixed with the air 6, resulting in an exemplary distribution indicated by arrows 40, 41, and 42, which is a shear flow in the swirler passage 16. Stream 41 may the wanted fuel to air ratio, which is an optimum regarding flame stabilisation and emissions. Stream 40 may be an air enriched fuel/air mixture, whereas stream 42 may be a fuel enriched fuel/air mixture, which both may lead to decreased flame stabilisation in case of a lean fuel/air mixture or may lead to higher emissions of $NO_x$ in non-lean operation.

Figure 5:
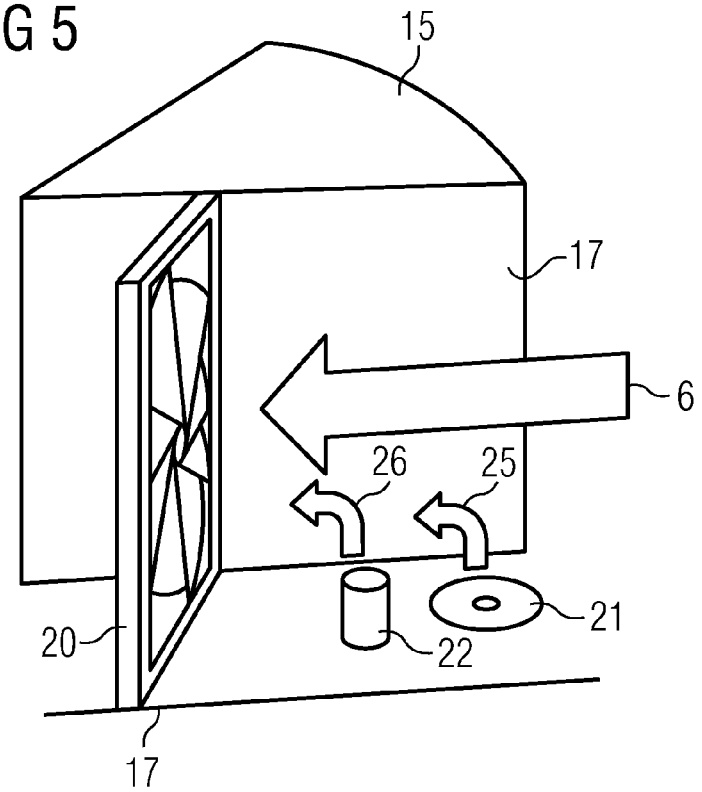
FIG. 5 shows a fraction of a swirler in a perspective view with an axial swirler in a swirler passage.

This is overcome by applying the axial swirler 20 in the swirler passage 16, as it can be seen in FIG. 3 and FIG. 5. With that the air 6, the liquid fuel 26, and gas fuel 25 all pass the axial swirler 20 and get redirected and mixed.

Figure 6:
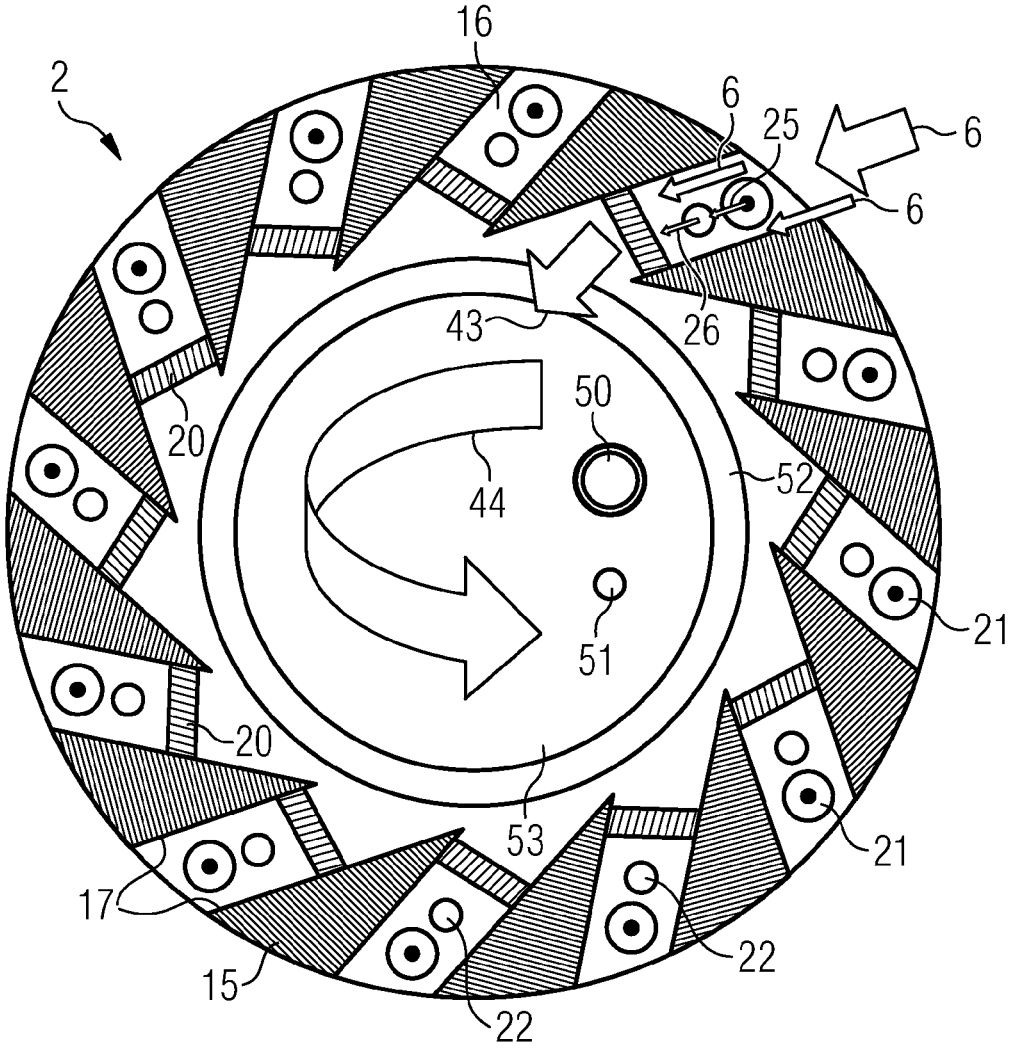
FIG. 6 shows schematically a top view from the downstream side of a combustion chamber, as indicated in FIG. 1 by arrows A-A.

FIG. 6 shows schematically a top view from the downstream side of a combustion chamber, as indicated in FIG. 1 by arrows A-A. The swirler 2 is shown and a burner face 53 of the burner-head 1. It is shown for one specific swirler passage 16, that air 6 entering the swirler passage 16 will flow through the swirler passage 16—indicated by two smaller arrows with the reference sign 6—and the liquid fuel 26 and gas fuel 25 will be injected into the swirler passage 16. All of these streams, partly mixed, then flow downstream and get additionally mixed by the axial swirler 20, which is present in the swirler passage 16. A more homogenous air/fuel mixture 43 leaves the individual swirler passages 16 and will enter the centre zone of the swirler 2. Finally, all of these passage individual air/fuel mixtures 43 will experience a swirl as indicated by arrow 44 around the central axis of the swirler 2.

Further components that can be seen in FIG. 6 are an igniter 50 in the area of the burner face 53, a first pilot fuel injection 51 for liquid fuel and a second pilot fuel injection 52 for gaseous fuel. Both fuel injections 51 and 52 will be considered the "further fuel injection opening" or the "additional fuel injection opening" according to the claims.

The pilot fuel injections may optionally be present in all of the embodiments of the invention. The first pilot fuel injection 51 for liquid fuel is in the form of a valve. Only a single first pilot fuel injection 51 is shown in the figure but several can be present, preferably near the centre of the burner. The second pilot fuel injection 52 is shown in form of a ring so that pilot gas can be injected circumferentially at the ends of the swirler passages 16. It has to be noted that also other forms and locations of fuel injections may be possible. And as in all embodiments of the invention, a burner may be limited to only liquid fuel or only to gaseous fuel.

Advantageously the first pilot fuel injection 51 for liquid fuel and the second pilot fuel injection 52 for gaseous fuel are located downstream of the axial swirler 20. During operation of the gas turbine, the fuel—either gas or liquid—is introduced in two stages: with a main injection via the liquid fuel injector 22 and/or the gas fuel injector 21, which results in a high degree of premixedness and hence low $NO_x$ emissions, and a pilot injection via the first pilot fuel injection 51 for liquid fuel and/or the second pilot fuel injection 52 for gaseous fuel. The pilot injection may steadily be increased as the load demand decreases in order to ensure flame stability, which may not be guaranteed with lower loads. The first pilot fuel injection 51 for liquid fuel and/or the second pilot fuel injection 52 for gaseous fuel are arranged, such that as the pilot fuel split increases, the fuel is biased towards the axis—axis 12 as indicated in FIG. 1—of the combustor. This avoids problems with combustion instability at lower loads.

In operation mode with lean premix combustion, which may be selected to reduce $NO_x$, pilot fuel injection may even be advantageous to stabilize the flame even at full load, however, the percentage of fuel injected via the pilot fuel injection 51 and 52 compared to the overall fuel injection may be small for full load, for example 5%.

With the pilot fuel injection severe combustion dynamics may be avoided, which otherwise could take place due to combustion at near limit of flammability.

Figure 7:
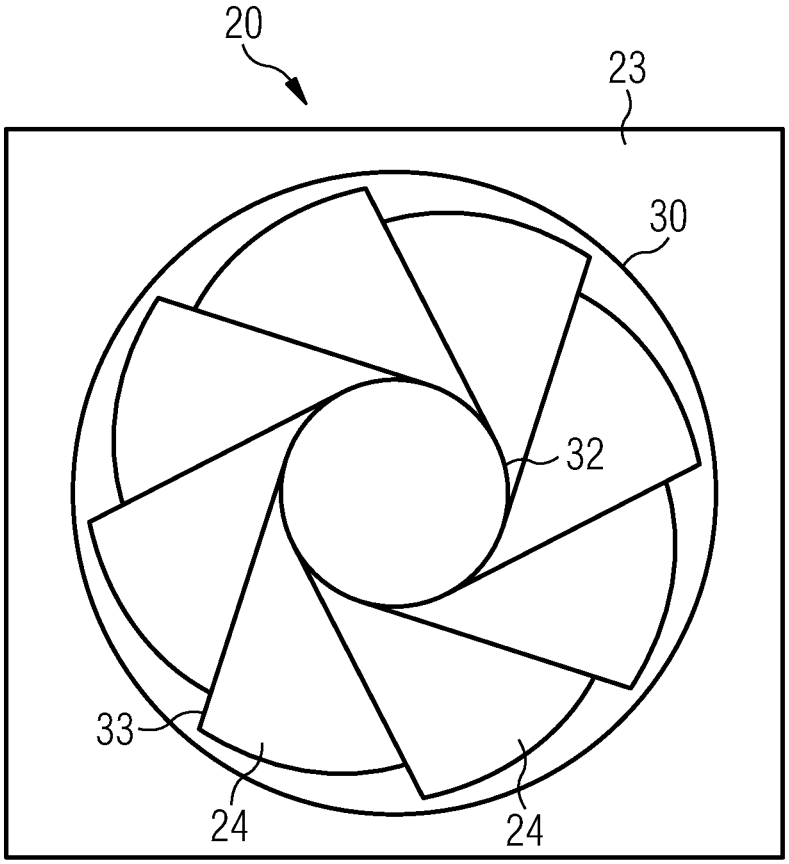
FIG. 7 shows schematically a first form of an axial swirler applicable to the swirler of FIG. 3.
Figure 8:
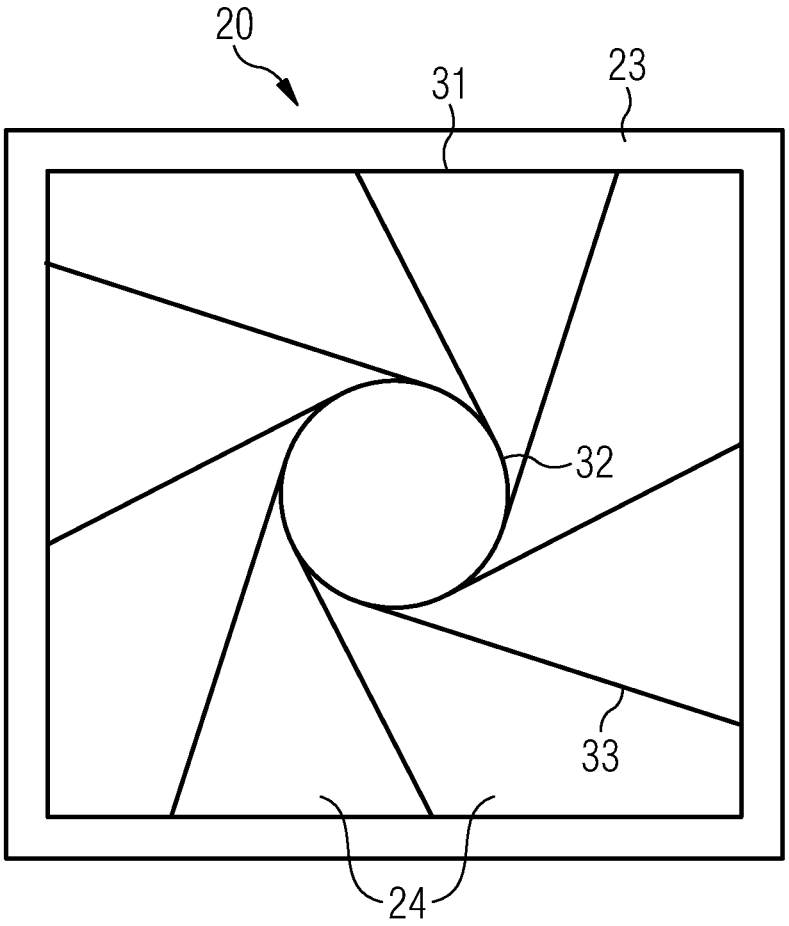
FIG. 8 shows schematically a second form of an axial swirler applicable to the swirler of FIG. 3.

In FIGS. 7 and 8, exemplary forms of the axial swirler 20 is schematically shown, seen from a direction as indicated by the arrow 6 in FIG. 5.

In FIG. 7 the axial swirler 20 has a rectangular frame 23, and a central structure with a tube like round perimeter 30, the central structure comprising a plurality of airfoils 24 from which only the leading edges 33 and a part of the leading surfaces can be seen. The airfoils 24 are tilted and are overlapping each other so that passages are created to pass the pre-mixed stream of air and fuel (indicated in FIG. 6 by reference signs 6, 25, and 26) giving it a rotational movement.

In the example the airfoils 24 are fixed at a specific position between perimeter 30 and an inner ring 32. The sizes of the perimeter 30 and the inner ring 32 in the figure may only be seen as examples.

FIG. 8 shows an alternative to the embodiment of FIG. 7, in which an outer perimeter 31 is a rectangular, if seen from the upstream side. It can also be seen as a cuboid with missing side faces at the upstream and downstream sides. The airfoils 24 will extend up the perimeter 31. Besides that they may not differ substantially to the airfoils 24 of FIG. 7.

The axial swirler 20 may be constructed in several ways. Besides the two examples of FIGS. 7 and 8, also several modifications are possible. For example the leading edges 33 may not be straight but curved. The leading edges 33 may rounded or sharp. The surfaces of the airfoils 24 may be flat or bent. The inner ring 32 and the outer frame 23 may be of different sizes and forms in different embodiments. All of these possibilities should be optimised so that the shear flow in the swirler passage 16 is overcome and the mixing is more perfectly. This then leads to a more stabilised flame, also in a lean operation, and consequently also to less $NO_x$ emissions.

The invention claimed is:

1. A swirler for mixing fuel and air, comprising:

a plurality of vanes positioned radially around a central axis of the swirler, a plurality of mixing channels for mixing fuel and air, wherein at least one mixing channel of the plurality of mixing channels defined by opposite walls of two adjacent vanes of the plurality of vanes, wherein the at least one mixing channel comprises at least one fuel injection opening arranged at a first section of the at least one mixing channel, and wherein the at least one mixing channel further comprises an axial swirler extending between the walls of the two adjacent vanes, the axial swirler being arranged at a second section of the at least one mixing channel, the second section being located downstream of the first section with respect to a flow direction through the mixing channel, and wherein the axial swirler comprises a plurality of swirler airfoils.

2. The swirler according to claim 1, wherein the axial swirler is arranged substantially perpendicular to the walls of the two adjacent vanes.

3. The swirler according to claim 1, wherein the axial swirler comprises a rectangular solid frame surrounding the plurality of swirler airfoils.

4. The swirler according to claim 3, wherein the plurality of swirler airfoils have an elliptical outer perimeter connected to the solid frame via the outer perimeter.

5. The swirler according to claim 4, wherein elliptical outer perimeter is circular in shape.

6. The swirler according to claim 4, wherein the plurality of swirler airfoils have a rectangular outer perimeter connected to the solid frame via this outer perimeter.

7. The swirler according to claim 5, wherein rectangular outer perimeter is square in shape.

8. The swirler according to claim 1, wherein the plurality of swirler airfoils is arranged to provide a mixing channel individual rotating airflow for the at least one mixing channel.

9. The swirler according to claim 1, wherein each of the plurality of swirler airfoils has a straight leading edge.

10. The swirler according to claim 1, wherein each of the plurality of swirler airfoils has a curved leading edge.

11. The swirler according to claim 1, wherein a first one of the at least one fuel injection opening is arranged to inject liquid fuel into an air flow flowing through the at least one mixing channel or through any one of the plurality of mixing channels.

12. The swirler according to claim 1, wherein a second one of the at least one fuel injection opening is arranged to inject gaseous fuel into the air flow flowing through the same one of at least one mixing channel or through any one of the plurality of mixing channels.

13. The swirler according to claim 11, wherein a second one of the at least one fuel injection opening is arranged to inject gaseous fuel into the air flow flowing through the same one of at least one mixing channel or through any one of the plurality of mixing channels.

14. The swirler according to claim 1, further comprising at least one further fuel injection opening arranged at a downstream-third section of the at least one mixing channel, the third section being located further downstream of the axial swirler with respect to said flow direction.

15. The swirler according to claim 14, wherein the further fuel injection opening is configured such that the fuel injection is controllable separately from the at least one fuel injection opening.

16. A combustion chamber comprising:

a swirler for mixing fuel and air, the swirler comprising:

a plurality of vanes positioned radially around a central axis of the swirler, a plurality of mixing channels for mixing fuel and air, wherein at least one mixing channel of the plurality of mixing channels defined by opposite walls of two adjacent vanes of the plurality of vanes, wherein the at least one mixing channel comprises at least one fuel injection opening arranged at a first section of the at least one mixing channel, and wherein the at least one mixing channel further comprises an axial swirler extending between the walls of the two adjacent vanes, the axial swirler being arranged at a second section of the at least one mixing channel, the second section being located downstream of the first section with respect to a flow direction through the mixing channel, and wherein the axial swirler comprises a plurality of swirler airfoils.

17. The combustion chamber according to claim 16, further comprising a burner-head, the burner-head comprising at least one additional fuel injection opening arranged downstream of the plurality of mixing channels for mixing fuel and air.

18. A gas turbine comprising:

at least one combustion chamber, the at least one combustion chamber comprising:

a swirler for mixing fuel and air, the swirler comprising:

a plurality of vanes positioned radially around a central axis of the swirler, a plurality of mixing channels for mixing fuel and air, wherein at least one mixing channel of the plurality of mixing channels defined by opposite walls of two adjacent vanes of the plurality of vanes, wherein the at least one mixing channel comprises at least one fuel injection opening arranged at a first section of the at least one mixing channel, and wherein the at least one mixing channel further comprises an axial swirler extending between the walls of the two adjacent vanes, the axial swirler being arranged at a second section of the at least one mixing channel, the second section being located downstream of the first section with respect to a flow direction through the mixing channel, and wherein the axial swirler comprises a plurality of swirler airfoils.

* * * * *